US005823077A

United States Patent [19]

Macor

[11] Patent Number: 5,823,077

[45] Date of Patent: Oct. 20, 1998

[54] DOUBLE-ENDED WRENCH

[75] Inventor: Richard J. Macor, Warren County, N.J.

[73] Assignee: Proprietary Technologies, Inc., Stewartsville, N.J.

[21] Appl. No.: 646,954

[22] Filed: May 8, 1996

Related U.S. Application Data

[63] Continuation-in-part of Ser. No. 500,178, Jul. 10, 1995.

[51] Int. Cl.[6] ..... B25B 23/16

[52] U.S. Cl. ..... 81/177.1; 81/180.1; 81/125.1

[58] Field of Search ..... 81/125.1, 177.1, 81/180.1, 184, 185.2, 489, 300, 303, 321, 322; D8/DIG. 7; 16/110 R, 114 R; 7/167; 15/143.1; 74/558.5; 294/57, 59

[56] References Cited

U.S. PATENT DOCUMENTS

| | | | |
|---|---|---|---|
| 271,303 | 1/1883 | Blaker | 294/57 |
| 1,169,496 | 1/1916 | Knauff | 81/125.1 |
| 3,981,043 | 9/1976 | Curry | 16/110 R |
| 4,406,188 | 9/1983 | Mills | 81/180.1 |
| 4,972,733 | 11/1990 | Olmr et al. | 81/177.1 |
| 5,003,849 | 4/1991 | Lawrie | 81/184 |
| 5,003,850 | 4/1991 | Harkins | 81/184 |
| 5,115,530 | 5/1992 | Distiso | 81/489 |
| 5,133,101 | 7/1992 | Hauser et al. | 15/143.1 |
| 5,269,045 | 12/1993 | DeSerio et al. | 81/489 |
| 5,299,475 | 4/1994 | Stroop | 81/489 |
| 5,390,746 | 2/1995 | Page | 81/489 |
| 5,549,167 | 8/1996 | Keperling, Sr. et al. . | |

*Primary Examiner*—David A. Scherbel
*Assistant Examiner*—Joni B. Danganan

[57] ABSTRACT

A double-ended wrench is described with a movable gripping means to improve user comfort, torque and continuous-use capabilities. The double-ended wrench has two wrench heads positioned, one at each end of an elongated handle. The gripping means is formed shorter than and for movement along the elongated handle of the wrench so that the gripping means may be positioned at each end of the wrench handle without obstructing the other end of the wrench. In addition, the gripping means has features specific to the application and a cavity therein with a dimension less than a dimension of each of the wrench heads so that the movement of the wrench grip along the elongated wrench handle is confined by the two wrench heads, keeping the grip upon the wrench.

20 Claims, 2 Drawing Sheets

DOUBLE-ENDED WRENCH

REFERENCE TO RELATED CASE

This application is a continuation-in-part of currently copending U.S. patent application Ser. No. 08/500,178, filed on Jul. 10, 1995, by Richard J. Macor, entitled "DOUBLE ENDED WRENCH WITH MOVABLE GRIP".

BACKGROUND OF THE INVENTION

1. Field of the Invention

The present invention relates to tools, particularly hand tools and most particularly double-ended wrenches. A double-ended wrench as defined herein, means any wrench having two wrench heads positioned, one at each end of an elongated handle. The present invention involves a double-ended wrench with a movable gripping means. The present invention further involves a gripping means that has features specific to the application and dimensions that rely upon the dimensions of the double-ended wrench it is used in combination with.

2. Information Disclosure Statement

By design, a double-ended wrench gains versatility (two wrench heads) at the expense of user comfort (loss of a practical gripping means or comfortable handle). Because there are no practical grips or comfortable handles for double-ended wrenches, a user must rely upon the integral, elongated handle of the wrench which has a shape and configuration that promotes discomfort and fatigue. This discomfort and fatigue has an adverse affect on the torque and continuous-use capabilities of the tool. These problems and the affects thereof are particularly realized by mature, professional mechanics.

Applicant is not aware of any prior art that specifically addresses the discomfort, fatigue, reduced torque and continuous-use capabilities associated with double-ended wrenches. The closest prior art known to the applicant is U.S. Pat. No. 4,406,188 issued to Blaine N. Mills who discloses a nut-holder attachment for an open-end wrench. In only one embodiment, he discloses a nut-holder attachment used in conjunction with a wrench grip that is preferably as long as the wrench shank (handle) and secure upon the wrench. Such an arrangement would at all times obstruct both ends of the wrench handle and at least one wrench head, creating additional clearance requirements around the wrench and impeding the normal operation of the tool.

Although less pertinent, other known U.S. patents are: U.S. Pat. Nos. 2,466,884; 3,981,043; 4,890,355; 5,115,530; and 5,390,746.

Notwithstanding the above referenced prior art, no patent teaches or renders obvious the present invention, a double-ended wrench with a movable gripping means that can be positioned at each end of the wrench without obstructing the other end thereof to improve the comfort, torque and continuous-use capabilities of the wrench, and without impeding the normal operation of the tool.

SUMMARY OF THE INVENTION

The present invention involves a double-ended wrench that has two wrench heads positioned, one at each end of an elongated handle, and a wrench grip that is formed shorter than and for movement along the wrench handle so that the wrench grip may be positioned at each end of the wrench handle without obstructing the other end of the wrench (handle and head). In addition, the wrench grip has a cavity therein with a dimension less than a dimension of each of the wrench heads so that the movement of the wrench grip along the wrench handle is confined by the two wrench heads, and the wrench grip is therefore contained upon the wrench.

In some embodiments, the gripping means of the present invention may have a cavity with a central part and two ends, and at least one of the two ends may have a width dimension greater than a width dimension of the central part. The central part of the gripping means cavity shall be defined herein as any area of the gripping means cavity which has a lesser width dimension than the width dimension of a cavity outer end. In the same or other embodiments of the present invention, the gripping means may have an inner and outer member, with the outer member extending beyond the inner member. In both cases, these features permit movement of the grip close to or partially onto a wrench head, thereby providing a comfortable transition between grip and wrench head for the user, and keeping the other end of the wrench (head and handle) free and clear of the grip for normal operation and fastener engagement.

In one preferred embodiment, the gripping means of the present invention has an inner member and an outer member. The inner member is formed to substantially encompass a portion of the wrench handle, and the outer member is formed to substantially encompass a portion of the inner member. The inner member comprises two interconnecting parts that are assembled together as one onto the wrench to facilitate attachment and detachment with the wrench. The outer member is substantially elastic and continuous. The outer member is positioned upon and stretched around the inner member to provide continuous pressure around the inner member and keep the inner member together on the wrench. This arrangement also provides friction between the inner member and wrench so that unintentional movement of the grip along the wrench is prohibited while intentional movement of the grip along the wrench is permitted when sufficient force is applied to the grip to render it movable along the wrench.

Accordingly, it is a primary object of the present invention to improve the comfort, torque and continuous-use capabilities of a double-ended wrench as defined herein.

It is another important object of the present invention to provide the above improvements without limiting or precluding normal operation of the tool.

It is another important object of the present invention to provide a gripping means that is commercially viable, simple in design, cost-efficient to manufacture, and durable under extended professional/industrial use.

It is a another object of the present invention to provide a gripping means with considerations for user ergonomics and one-handed repositioning.

BRIEF SUMMARY OF THE DRAWINGS

The present invention as described in this specification will be more fully understood when taken in conjunction with the drawings appended hereto, wherein.

DETAILED DESCRIPTION OF THE DRAWINGS

The present invention is directed towards the improvement of double-ended wrenches. A double-ended wrench is defined herein as any wrench having two wrench heads (regardless of type) positioned, one at each end of an elongated central portion or handle, and each of the wrench heads have a configuration capable of controlling the rotation of a fastener. A double-ended wrench may have two wrench heads of the same type, each having a different size thereon; or two wrench heads of different types, each having the same size thereon. Respective examples would be a double-ended box wrench and a double-ended combination wrench. A double-ended wrench may have any head type or combination thereof including but not limited to; open-end, box, ratcheting box, flare nut and flex head.

There are instances where a single-ended wrench has a gripping means or grip at one end of the wrench to promote comfort and reduce fatigue. Such an arrangement for a single-ended wrench is practical, and the grip does not obstruct the other end of the wrench (head and handle) which is used to engage and control the rotation of nuts, bolts and other fasteners. When considering a gripping means for a double-ended wrench, one might assume that a double-ended wrench would require a long grip extending the length of the elongated wrench handle, or possibly two smaller grips positioned, one at each end of wrench. Unfortunately, both of these assumed arrangements would be impractical, with the gripping means obstructing both wrench heads and seriously affecting the normal operation of the tool. In addition, it would be very difficult to install a conventional single-ended wrench type grip onto a double-ended wrench because the wrench heads of most double-ended wrenches are physically larger than the elongated handle they are connected to, precluding installation of a single-ended wrench type grip onto a double-ended wrench.

Because a double-ended wrench does not have a comfortable handle or practical gripping means, a user must rely upon the integral handle of the wrench which has a shape and configuration that promotes user discomfort and fatigue. This discomfort and fatigue has an adverse affect on the torque and continuous-use capabilities of the tool. Therefore, it is a primary object of the present invention to improve the comfort, torque and continuous-use capabilities of a double-ended wrench without limiting or precluding normal operation of the tool. This objective is accomplished through the present invention, a double-ended wrench with movable gripping means having features specific to the application.

Figure 1:
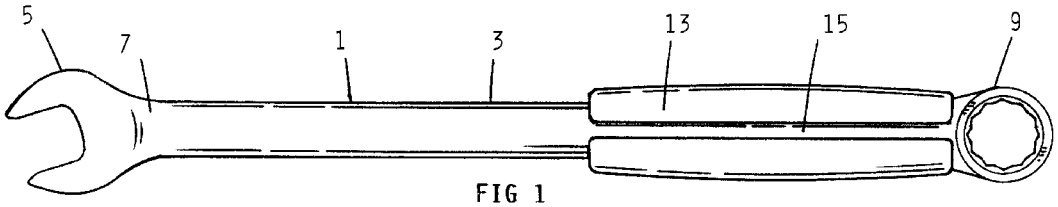
FIG. 1 is a top view of a present invention double-ended wrench and movable gripping means.

Referring now to FIG. 1, there is shown top view of a present invention double-ended wrench 1, having an elongated central portion or handle 3, wrench heads 5 and 9, neck area 7 next to wrench head 5, and gripping means 13 with seam 15. Open-end type wrench head 5 combined with box type wrench head 9 form what is known as a combination type wrench. A combination type wrench is just one form of a double-ended wrench. In this Figure, gripping means 13 is positioned at one end of elongated handle 3 and next to box wrench head 9, allowing use of open-end wrench head 5. Please note that gripping means 13 is formed shorter than and for movement along elongated handle 3 of wrench 1 so that gripping means 13 may be positioned at each end of elongated handle 3 without obstructing the other end of the wrench used to access and engage nuts, bolts and fasteners. In addition, please note that a substantial portion of elongated handle 3 next to wrench head 5 is unobstructed by movable gripping means 13 so that wrench head 5 may access a fastener normally, without additional clearance requirements. During the application of torque, movable gripping means 13 will have a tendency to move away from center and off the end of wrench 1. Please note, box wrench head 9 will prevent movable gripping means 13 from moving off of wrench 1 because movable gripping means 13 has a cavity therein with a dimension much smaller than an outer dimension of wrench heads 9 and 5 so that the movement of gripping means 13 along elongated wrench handle 3 is confined by wrench heads 9 and 5, thereby containing gripping means 13 upon wrench 1. Without movable gripping means 13, a user would rely upon elongated handle 3 to apply torque to wrench 1. Elongated handle 3 is not very thick, promoting discomfort and fatigue. In fact, a user may have to stop periodically during continuous use to minimize discomfort and fatigue. Movable gripping means 13 however, provides a thicker, more comfortable surface for the user to apply torque, thereby improving comfort, torque and continuous-use capabilities at each end of double-ended wrench 1.

Figure 2:
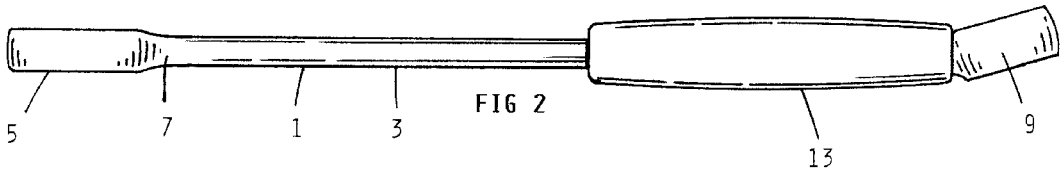
FIG. 2 is a left side view of the present invention double-ended wrench and movable gripping means shown in FIG. 1.

FIG. 2 illustrates a left side view of the present invention double-ended wrench shown in FIG. 1. In this figure please note how thin wrench handle 3 is. Without movable wrench grip 13, a user must rely upon this wrench handle 3 to apply torque. It is easy to understand how such use can promote discomfort and fatigue.

Figure 3:
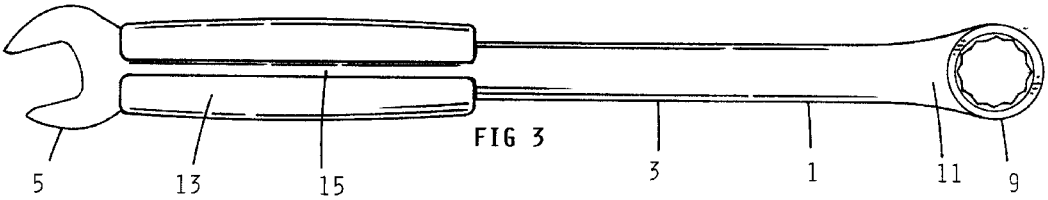
FIG. 3 is a top view of the present invention double-ended wrench and movable gripping means shown in FIGS. 1 and 2, but with the gripping means repositioned upon the wrench.

FIG. 3 illustrates a top view of the present invention double-ended wrench shown in FIG. 1 except, gripping means 13 has been repositioned to the other end of elongated handle 3 of wrench 1 and next to open-end wrench head 5, allowing use of box wrench head 9. Please note, a substantial portion of elongated handle 3 next to wrench head 9 is unobstructed by movable gripping means 13 so that, wrench head 9 may access a fastener normally, without additional clearance requirements. During the application of torque, movable gripping means 13 will have a tendency to move away from center and off the end of wrench 1. Please note, open-end wrench head 5 will prevent movable gripping means 13 from moving off of wrench 1 because movable gripping means 13 has a cavity therein with a dimension much smaller than an outer dimension of wrench heads 9 and 5 so that the movement of gripping means 13 along wrench handle 3 is confined by wrench heads 9 and 5, thereby containing gripping means 13 upon wrench 1.

Figure 4:
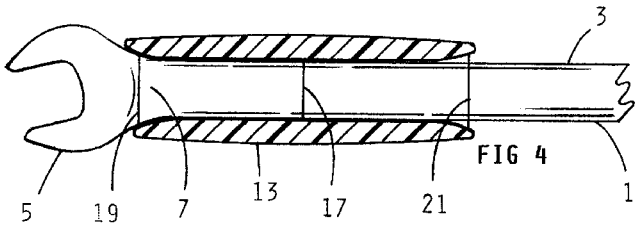
FIG. 4 is a top partial view of the double-ended wrench and a top cross-section view of the gripping means shown in FIGS. 1, 2, and 3.

FIG. 4 is a top partial view of the double-ended wrench and a top cross-section view of the gripping means shown in FIGS. 1, 2, and 3. In this view, the cavity of gripping means 13 is shown with central part 17, and two ends 19 and 21. Cavity central part 17 has a dimension less than an outer dimension of open-end wrench head 5 to contain gripping means 13 upon wrench 1. Cavity ends 19 and 21 each have a dimension greater than a dimension of cavity central part 17 to accommodate the neck areas of wrench 1 represented by neck area 7 in this view. Virtually all double-ended wrenches have neck areas, which are areas of transition located between the elongated wrench handle and each wrench head. Each neck area of a double-ended wrench generally has a dimension greater than a dimension of the elongated wrench handle, but less than a dimension of the wrench head it adjoins. Recognition of these wrench neck areas and modification of the gripping means cavity to accommodate these neck areas is an important feature of the present invention gripping means. This feature permits movement of the gripping means to or partially onto a wrench head, which provides a user with a comfortable transition between the gripping means and the wrench head it is next to, while maintaining minimal free play and wobble between gripping means and wrench.

Figure 5:
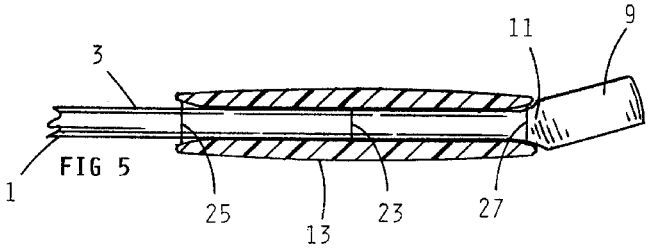
FIG. 5 is a left side partial view of the double-ended wrench and a left side cross-section view of the gripping means shown in FIGS. 1, 2, and 3.

In FIG. 5, there is shown a left side, partial view of the double-ended wrench and a left side, cross-section view of the gripping means shown in FIGS. 1, 2, and 3. Side view cavity areas and dimensions of gripping means 13 can be seen. In this view, the cavity of gripping means 13 is shown with central part 23, and two ends 25 and 27. Cavity central part 23 has a dimension less than an outer dimension of box wrench head 9 to contain gripping means 13 upon wrench 1. Cavity ends 25 and 27 each have a dimension greater than a dimension of cavity central part 23, to accommodate the neck areas of wrench 1 represented by neck area 11 in this view.

Figure 6:
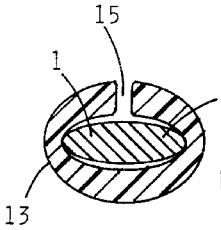
FIG. 6 is a front, cross-section view of the double-ended wrench and gripping means shown in FIGS. 1, 2, 3, 4 and 5.

FIG. 6 is a front, cross-section view of the double-ended wrench and gripping means shown in FIGS. 1, 2, 3, 4 and 5. Gripping means 13 is made out of a resin or plastic-like material having some elastic properties. Gripping means 13 has an inner cavity with a dimension slightly less than a dimension of wrench handle 3 to provide and maintain a level of friction between wrench handle 3 and gripping means 13. This planned friction between wrench and grip prohibits unintentional movement of the grip along the wrench handle while permitting intentional movement of the grip along the wrench handle, preferably with the use of one hand. Gripping means 13 is installed upon wrench handle 3 by pushing the open part of seam 15 of grip 13 onto the thinnest part of wrench handle 3, then rotating gripping means 13 or wrench 1, 90 degrees relative to the other to secure gripping means 13 upon wrench handle 3 of wrench 1. From this view, it is easy to see how seam 15 will facilitate attachment and detachment of gripping means 13 with wrench handle 3. Gripping means 13 can comprise one part or several parts that are assembled together as one onto the wrench handle with the use of interlocking tabs, barbed pins, fasteners or any other acceptable means. Gripping means 13 can be made out of a variety of different materials or combinations thereof and achieve acceptable friction and installation results. For preferred embodiments of the present invention, applicant contemplates a plastic-like material that is resilient and somewhat elastic. It is important to note that most double-ended wrenches have an elongated handle with dimensions that deviate slightly from one end to the other. A rigid gripping means without an open seam, may not be able to maintain an acceptable level of friction over the entire length of the elongated wrench handle. A gripping means with an open seam however, will be able to maintain an acceptable level of friction over the entire length of the elongated wrench handle because the open seam will open and close slightly to compensate for the slight changes in dimension occurring along the length of the elongated wrench handle.

Figure 7:
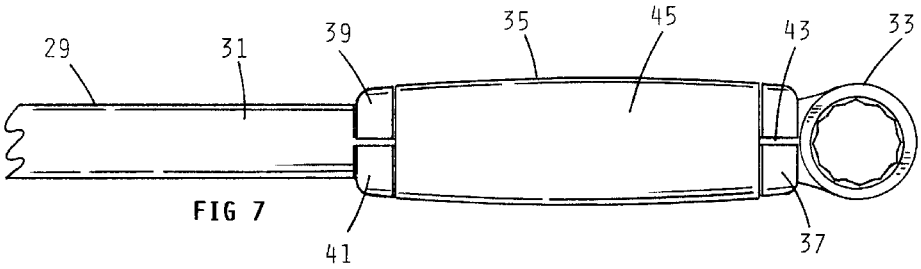
FIG. 7 is a top partial view of a present invention double-ended wrench and gripping means, with the gripping means having an inner and an outer member.

FIG. 7 is a top partial view of a present invention double-ended wrench and gripping means, with the gripping means having an inner and an outer member. Double-ended wrench 29 has elongated handle 31, wrench head 33 and movable gripping means 35 which is positioned next to wrench head 33. Gripping means 35 has a cavity therein with a dimension less than an outer dimension of wrench head 33 so that gripping means 35 can not be pulled off of double-ended wrench 29. Gripping means 35 has an inner member 37 which is formed to substantially encompass a portion of elongated wrench handle 31, and an outer member 45 which is formed to substantially encompass at least a portion of inner member 37. Inner member 37 comprises two corresponding interconnecting parts 39 and 41, which are assembled together as one upon wrench 29. Seam 43 defines one of two gaps between the two interconnecting parts 39 and 41. The other seam and gap are underneath gripping means 35 and not visible from this view. The seams facilitate attachment and detachment of gripping means 35 with wrench 29. Gripping means 35 also has vinyl outer member 45 which is somewhat elastic. Gripping means 35 is installed upon wrench 29 by first installing parts 39 and 41 of gripping means inner member 37 onto wrench 29. Then gripping means outer member 45 is stretched upon and around parts 39 and 41 of inner member 37 to hold and secure inner member 37 together and gripping means 35 upon wrench 29. Gripping means outer member 45 does not have any seams and is therefore continuous. Because gripping means outer member 45 is substantially continuous and elastic, pressure is created between the inner and outer members, and the inner member and wrench. This pressure provides for friction between gripping means 35 and elongated wrench handle 31 such that an application of predetermined force is necessary to render gripping means 35 movable upon wrench handle 31.

Figure 8:
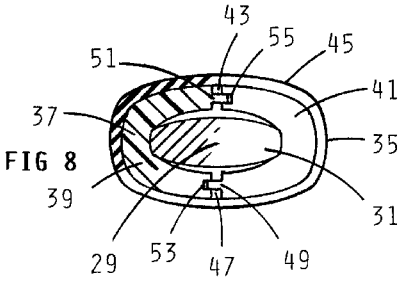
FIG. 8 is a front cross-section view of the present invention wrench and grip, shown in FIG. 7.

FIG. 8 is a front, cross-section view of the present invention wrench and grip, shown in FIG. 7. As mentioned earlier, inner member 37 comprises two corresponding interconnecting parts 39 and 41. Cylindrical pins 49 and 51 fit within corresponding orifices 53 and 55 to maintain alignment of interconnecting parts 39 and 41 of inner member 37 of gripping means 35. Such an arrangement will allow gripping means 35 to be used upon several wrenches having handles similar in size. If gripping means 35 was used upon a wrench handle having a lesser width than wrench handle 31 shown, the gaps at seams 43 and 47 would be slightly smaller. If gripping means 35 was used upon a wrench handle having a greater width than wrench handle 31 shown, the gaps at seams 43 and 47 would be slightly larger. In any event, it is important to maintain at least a very small gap between corresponding interconnecting parts 39 and 41 of inner member 37 so that, pressure is maintained and friction produced between inner member 37 and elongated handle 31 to preclude unintentional movement of gripping means 35 upon elongated wrench handle 31 of wrench 29.

Figure 9:
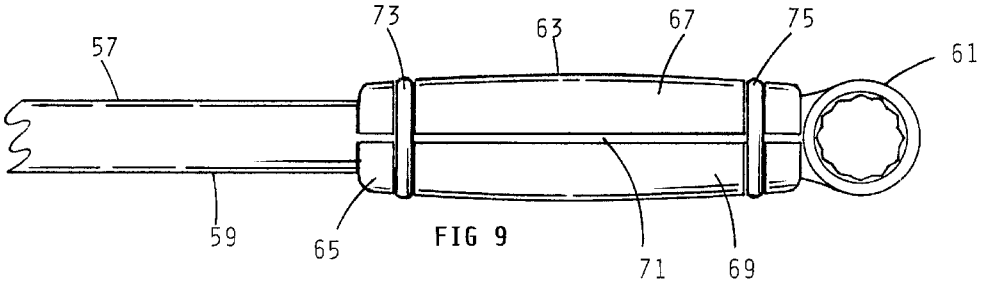
FIG. 9 is a top partial view of a present invention double-ended wrench and gripping means, with the gripping means having an inner member and two, elastic outer members.

FIG. 9 shows a top partial view of a present invention double-ended wrench and gripping means, with the gripping means having an inner member and two elastic outer members. Double-ended wrench 57 has elongated handle 59 and wrench head 61. Gripping means 63 has inner member 65 comprising parts 67 and 69 which are separated by seam 71. Seam 71 facilitates the attachment and detachment of gripping means 63 with double-ended wrench 57. Gripping means 63 also has two elastic outer members 73 and 75 which hold inner member 65 together, and provide for friction between inner member 65 and wrench elongated handle 59 when gripping means 63 is moved along wrench 57.

Figure 10:
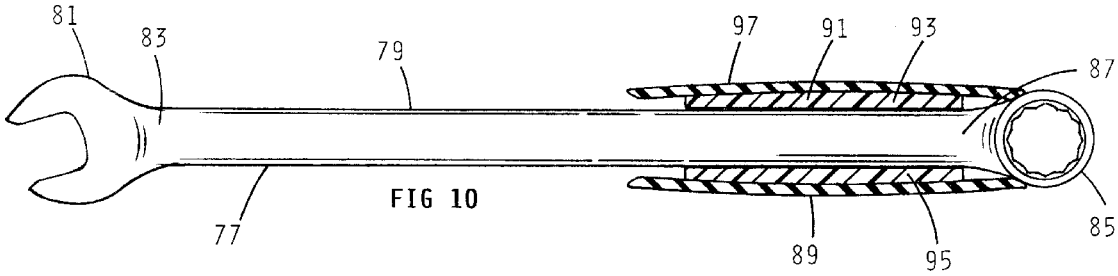
FIG. 10 is a top view of a present invention double-ended wrench and a top cross-section view of a gripping means, with the gripping means having an outer member and an inner member, and the outer member is extending beyond both ends of the inner member.

FIG. 10 shows a top view of a present invention double-ended wrench and a top cross-section view of a gripping means having an outer member and an inner member, and the outer member is extending beyond both ends of the inner member. Double-ended wrench 77 has elongated handle 79 with wrench head 81 at one end, and wrench head 85 at the other end. Wrench head 81 has neck 83 and wrench head 85 has neck 87. Neck 83 has a dimension greater than a dimension of elongated handle 79 but less than a dimension of wrench head 81 next to it, and neck 87 has a dimension greater than a dimension of elongated handle 79 but less than a dimension of wrench head 85 next to it. As defined earlier, the neck area of a wrench is the area located between wrench head and handle. All wrenches have neck areas and the shape and length of these areas vary with wrench size and different manufacturers. Gripping means 89 is positioned upon elongated handle 79 and next to wrench head 85 of wrench 77. When gripping means 89 is positioned next to wrench head 85, wrench head 81 of wrench 77 may be used as normal without obstruction from gripping means 89. Gripping means 89 has an inner member 91 and an outer member 97. In this embodiment, inner member 91 comprises two identical parts 93 and 95 which are molded from a relatively hard and durable plastic resin. Outer member 97 is molded from a relatively elastic and durable vinyl. Outer member 97 is stretched upon and around inner member 91 to contain gripping means 89 upon double-ended wrench 77. The elastic properties of outer member 97 also provide for a predetermined amount of friction between grip and wrench when gripping means 89 is moved along wrench handle 79. Outer member 97 extends beyond inner member 91 to permit movement of gripping means 89 close to or partially onto wrench head 85 or wrench head 81. This grip arrangement allows gripping means 89 to cover neck areas 83 or 87 of the wrench 77 thereby providing a user with a comfortable transition between grip and wrench head.

Figure 11:
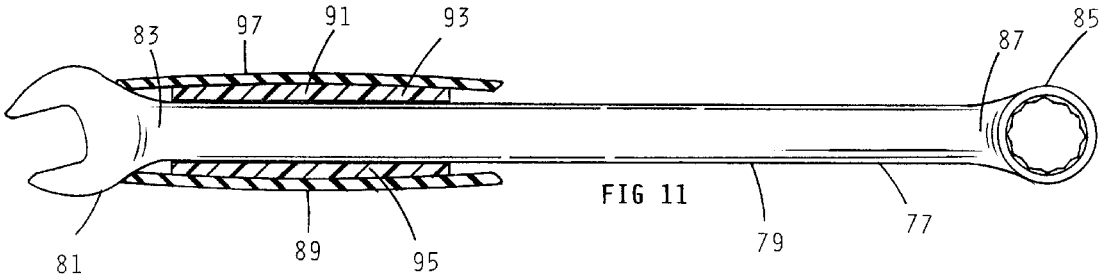
FIG. 11 is a top view of the present invention double-ended wrench and a top cross-section view of the gripping means shown in FIG. 10, but with the gripping means repositioned upon the wrench.

FIG. 11 is a top view of the present invention double-ended wrench and a top cross-section view of the gripping means shown in FIG. 10, but with the gripping means repositioned upon the wrench;

Having thus described the invention, what is claimed as new and desired to be secured by Letters Patent:

1. A double-ended wrench comprising:

two wrench heads positioned, one at each end of an elongated handle; and, a gripping means formed shorter than and for movement along said elongated handle whereby said gripping means is positionable at each end of said elongated handle without obstructing the other end thereof, said gripping means having a cavity therein with a central part and two ends, at least one of said two ends having a width dimension greater than a width dimension of said central part, and said central part having a dimension less than an outer dimension of each of said wrench heads whereby, the movement of said gripping means along said elongated handle is confined by said two wrench heads.

2. A double-ended wrench of claim 1, wherein said movable gripping means is frictionally attached to said double-ended wrench such that an application of predetermined force is necessary to render said gripping means movable upon said wrench.

3. A double-ended wrench of claim 2, wherein said gripping means has at least one seam to facilitate attachment and detachment with said double-ended wrench.

4. A double-ended wrench of claim 1, wherein said gripping means has at least one seam to facilitate attachment and detachment with said double-ended wrench.

5. A double-ended wrench of claim 4, wherein said gripping means comprises at least two interconnecting parts that are assembled together as one onto said double-ended wrench.

6. A double-ended wrench of claim 1, wherein said gripping means has an inner member and an outer member with said inner member formed to substantially encompass at least a portion of said elongated handle, and said outer member formed to substantially encompass at least a portion of said inner member.

7. A double-ended wrench of claim 6, wherein said gripping means outer member is substantially elastic and continuous.

8. A double-ended wrench of claim 6, wherein said gripping means inner member has two ends, and said gripping means outer member extends beyond at least one of said two ends of said gripping means inner member.

9. A gripping means for a double-ended wrench having two wrench heads positioned, one at each end of an elongated handle; said gripping means formed shorter than and for movement along said elongated handle whereby said gripping means is positionable at each end of said elongated handle without obstructing the other end thereof, said gripping means having a cavity therein with a central part and two ends, at least one of said two ends having a width dimension greater than a width dimension of said central part, and said central part having a dimension less than an outer dimension of each of said wrench heads whereby the movement of said gripping means along said elongated handle is confined by said two wrench heads.

10. A gripping means of claim 9, wherein said movable gripping means is frictionally attached to said double-ended wrench such that an application of predetermined force is necessary to render said gripping means movable upon said wrench.

11. A gripping means of claim 10, wherein said gripping means has at least one seam to facilitate attachment and detachment with said double-ended wrench.

12. A gripping means of claim 9, wherein said gripping means has at least one seam to facilitate attachment and detachment with said double-ended wrench.

13. A gripping means of claim 12, wherein said gripping means comprises at least two interconnecting parts that are assembled together as one onto said double-ended wrench.

14. A gripping means of claim 9, wherein said gripping means has an inner member and an outer member with said inner member formed to substantially encompass at least a portion of said wrench elongated handle, and said outer member formed to substantially encompass at least a portion of said inner member.

15. A gripping means of claim 14, wherein said gripping means outer member is substantially elastic and continuous.

16. A gripping means of claim 14, wherein said gripping means inner member has two ends, and said gripping means outer member extends beyond at least one of said two ends of said gripping means inner member.

17. A double-ended wrench comprising:

two wrench heads positioned, one at each end of an elongated handle, a wrench neck area between each said wrench head and said elongated handle; and, a gripping means formed shorter than and for substantial movement along said elongated handle whereby said gripping means is positionable at each end of said elongated handle without being removed from said double-ended wrench, said gripping means having a cavity therein with a dimension less than an outer dimension of each of said wrench heads whereby, the movement of said gripping means along said elongated handle is confined by said two wrench heads, and said gripping means cavity further having at least one end adapted to accommodate at least one of said wrench neck areas.

18. A double-ended wrench of claim 17, wherein said gripping means has an inner member and an outer member with said inner member formed to substantially encompass at least a portion of said wrench elongated handle, and said outer member formed to substantially encompass at least a portion of said inner member.

19. A double-ended wrench of claim 18, wherein said gripping means outer member is substantially elastic and continuous.

20. A double-ended wrench of claim 18, wherein said gripping means inner member has two ends, and said gripping means outer member extends beyond at least one of said two ends of said gripping means inner member.

* * * * *